US008069902B2

(12) United States Patent
Kang

(10) Patent No.: US 8,069,902 B2
(45) Date of Patent: Dec. 6, 2011

(54) ALUMINUM ALLOY VACUUM CASTING EQUIPMENT

(75) Inventor: Jingle Kang, Shandong (CN)

(73) Assignee: Jinan Casting Forging Machinery Institute Co., Ltd., Changqing, Jinan, Shandong (CN)

( * ) Notice: Subject to any disclaimer, the term of this patent is extended or adjusted under 35 U.S.C. 154(b) by 102 days.

(21) Appl. No.: 12/305,955

(22) PCT Filed: May 16, 2008

(86) PCT No.: PCT/CN2008/000953

§ 371 (c)(1), (2), (4) Date: Dec. 20, 2008

(87) PCT Pub. No.: WO2009/000143

PCT Pub. Date: Dec. 31, 2008

(65) Prior Publication Data

US 2011/0162815 A1 Jul. 7, 2011

(30) Foreign Application Priority Data

Jun. 28, 2007 (CN) ..... 2007 1 0014996

(51) Int. Cl.
*B22D 18/06* (2006.01)

(52) U.S. Cl. ..... 164/253

(58) Field of Classification Search ..... 164/253, 164/256, 258, 61

See application file for complete search history.

(56) References Cited

U.S. PATENT DOCUMENTS

| | | | | |
|---|---|---|---|---|
| 3,807,488 | A * | 4/1974 | Glazunov et al. | 164/514 |
| 4,741,384 | A * | 5/1988 | Healey | 164/514 |
| 5,133,400 | A * | 7/1992 | Bethge | 164/258 |
| 5,503,215 | A * | 4/1996 | Betz et al. | 164/258 |

* cited by examiner

*Primary Examiner* — Kevin P Kerns

(74) *Attorney, Agent, or Firm* — Global IP Services; Tianhua Gu

(57) ABSTRACT

An aluminum alloy vacuum casting equipment comprises a high pressure casting tank, in which a guard is equipped. The high-pressure casting tank is connected with a booster jar through a compressed air pipe. A first casting window and second casting window which are equipped with a first cylinder are set at top of the high-pressure casting tank. The high pressure casting tank is also equipped with a fixed guide and an unfixed guide at the bottom, an actuated exhaust ball valve at one side and a hatch door which is connected with a third cylinder. All operations except for putting in or taking out of the filler are completed automatically.

9 Claims, 3 Drawing Sheets

ALUMINUM ALLOY VACUUM CASTING EQUIPMENT

FIELD OF THE INVENTION

This invention concerns aluminum alloy production equipments, aluminum alloy vacuum casting equipments used for casting in vacuum.

BACKGROUND OF THE INVENTION

Casting of most aluminum alloy working pieces is completed in a tank body. Normally, a high pressure casting tank body is used for casting of working pieces, lift a sand-box onto a trolley, lay a guide in the high pressure casting tank down, and open a door manually. Push the sand-box trolley into the tank body and fix it in its position manually. Then, process the steps of casting positioning, casting, boosting, solidifying, exhaust and output of sand-box. All steps are completed manually.

Disadvantages of the old equipments: operations are mainly manual and much harder and dangerous; high percentage of waste castings, especially for casting of large and thin parts; there are many pinholes and secondary slag entrapments on the castings and the qualified rate is only about 30%. Therefore, how to avoid pinholes and secondary slag entrapments during casting of working pieces, improving casting quality of aluminum alloy working pieces become the key topics in this technical field. However, no good solution has been found.

SUMMARY OF THE INVENTION

The purpose of the present invention is to provide an aluminum alloy vacuum casting equipment, which uses automatic operation instead the manual operation, therefore, of hard manual work is reduced, the dangerous factors are eliminated and the rejection rate is reduced greatly.

For reaching above-mentioned purposes the following technology and solution is adopted in this invention:

The high pressure casting tank is equipped with a guide inside. The high-pressure casting tank is connected with one end of the compressed air pipe, the other end of compressed air pipe is connected with the booster jar. The compressed air pipe is equipped with an air inlet actuated ball valve. The first casting window and second casting window are set at top of the high-pressure casting tank. The first casting window and second casting window are equipped with a first cylinder at one side, the piston rod of the first cylinder is connected with the first connecting-rod, the first connecting-rod is connected with the casting window cover. The high pressure casting tank is equipped with a fixed guide and an unfixed guide at the bottom, and the unfixed guide is connected with the cylinder. The high pressure casting tank is equipped with a hatch door at one end which is connected with the door connecting-rod, the other end of door connecting-rod is connected with the high pressure casting tank. The hatch door is connected with the third cylinder. The high pressure casting tank is equipped with the actuated exhaust ball valve at one side. The high pressure casting tank is equipped with the first guard and second guard at inner top. The first guard is connected with the first connecting-rod via couplings, and the second guard is connected with the second connecting-rod via couplings. There are two unfixed guides. The lower part of the first unfixed guide is connected with the first pivot shaft, which is connected with the fourth cylinder via the connecting rod. The lower part of the second unfixed guide is connected with the second pivot shaft, which is connected with the fifth cylinder via connecting rod. The high pressure casting tank is equipped with the support rod on the inner wall. The high pressure casting tank is equipped with the vacuum pressure gauge, manual exhaust pipe and automatic exhaust pipe on the outer wall.

Advantages of this invention: all steps except for putting into or taking out of the filler are completed automatically. Thereby, casting in vacuum is realized, labor is reduced greatly, eliminating various risk factors during production is achieved. Especially, for casting of large and thin parts it is safe and reliable, the products qualified rate achieves to 98%, the manufacture cost is reduced greatly. This equipment also can greatly reduce the term for establishing needed negative pressure, that improves the steady casting. In addition, this equipment makes the heat treatment of castings and the oxidation for casting products of aluminum-magnesium alloy to become easy and popular.

DETAIL DESCRIPTION OF THE INVENTION

This invention is described in detail to combine with the Figures and preferred embodiments.

Figure 1:
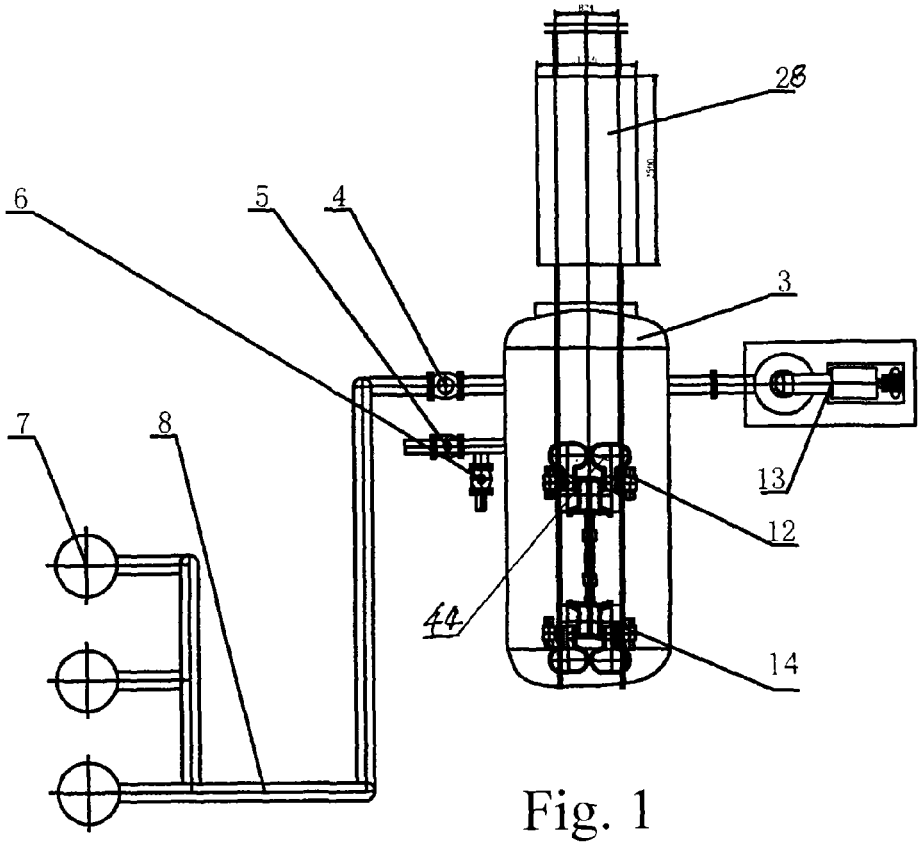
FIG. 1 shows the structure of this invention.
Figure 2:
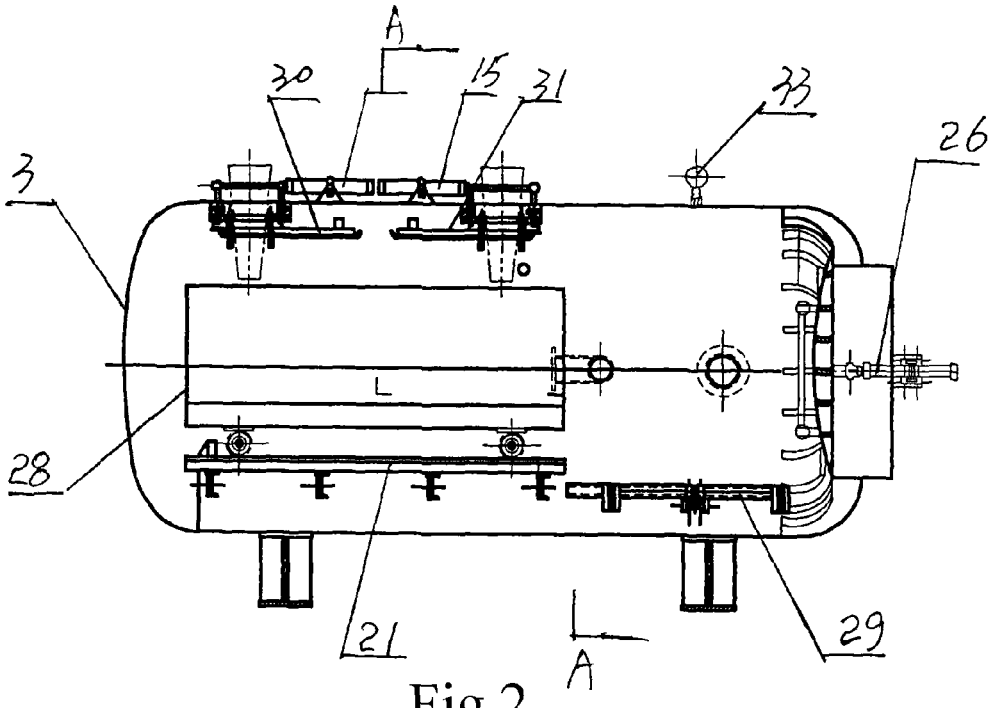
FIG. 2 shows the structure of the high pressure casting tank shown in the FIG. 1.
Figure 3:
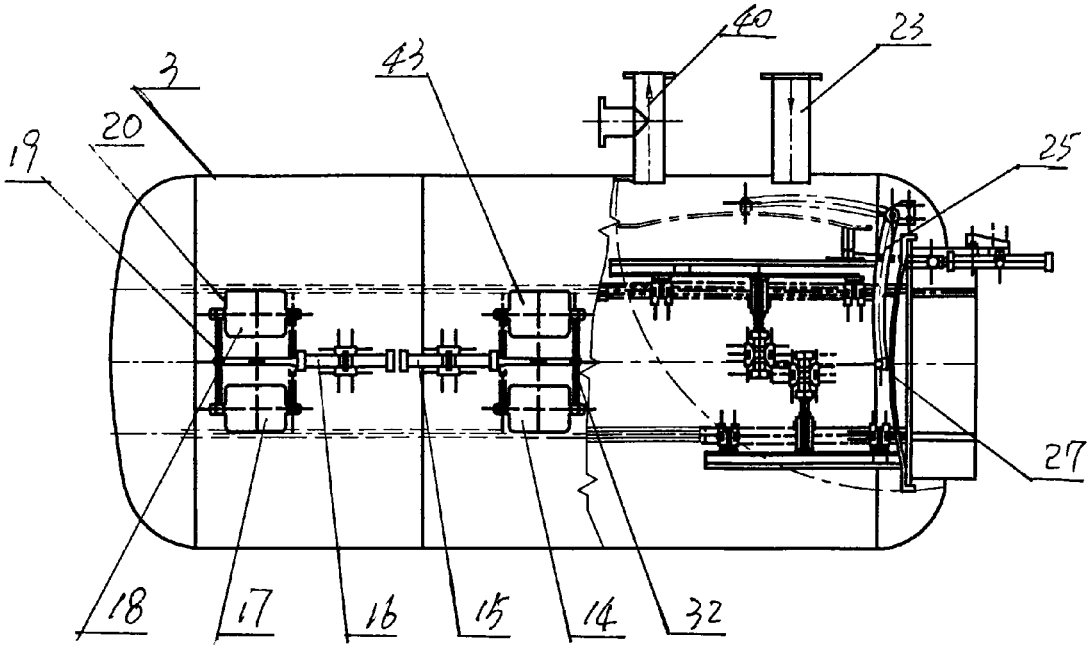
FIG. 3 is the top view of the high pressure casting tank shown in the FIG. 2.
Figure 4:
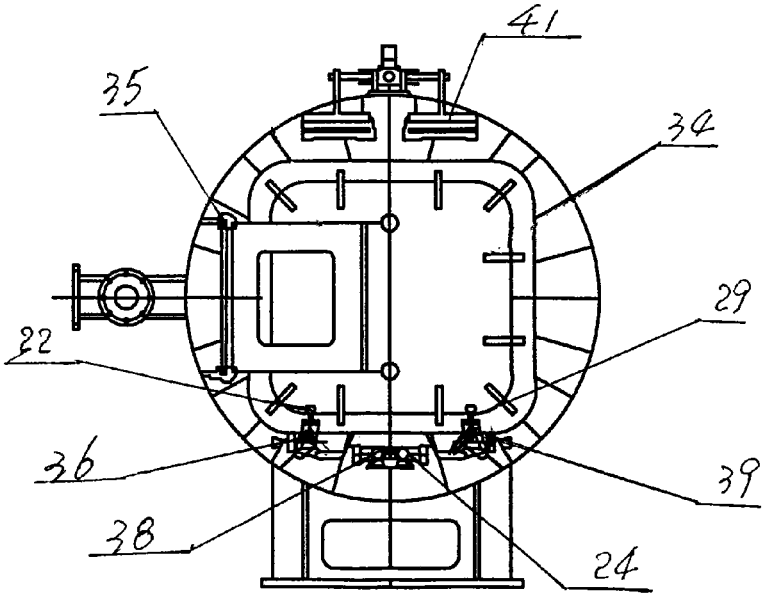
FIG. 4 is the cross section view along the A-A direction shown in the FIG. 2.
Figure 5:
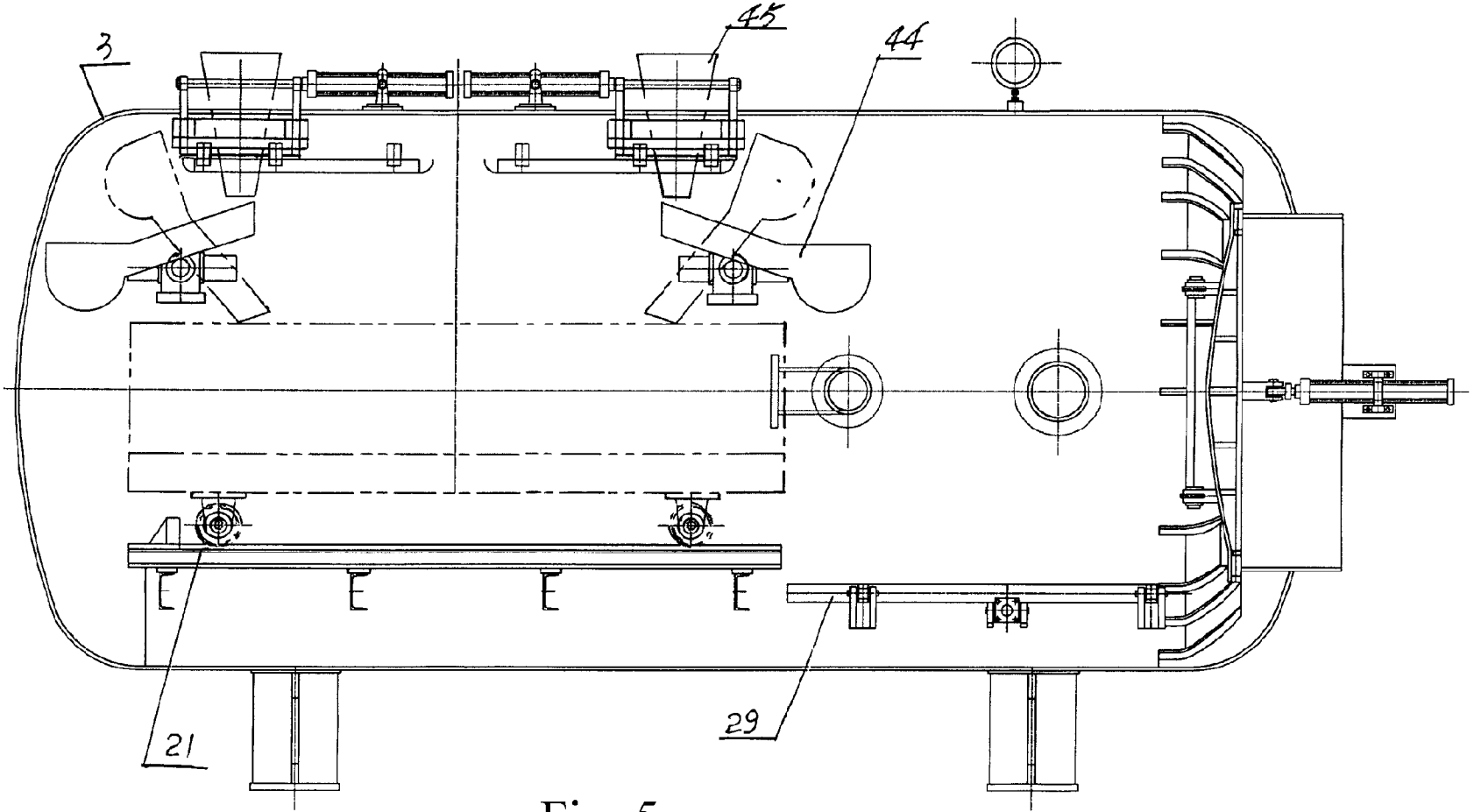
FIG. 5 shows the detail of high pressure casting tank shown in the FIG. 1, mainly showing the position of casting ladles.

The high pressure casting tank is shown in FIG. 3. The high pressure casting tank 3 is equipped with a guide inside. The high-pressure casting tank (3) is connected with the compressed air pipe (8) at one end. The other end of compressed air pipe (8) is connected with booster jar (7). The compressed air pipe (8) is equipped with an air inlet actuated ball valve (4). The first casting window (17), second casting window (18), third casting window (14) and fourth casting window (43) are set at the top of the high-pressure casting tank (3). The first casting window (17) and second casting window (18) are equipped with a first cylinder (16) at one side. The piston rod of first cylinder (16) is connected with the first connecting-rod (19). The first connecting-rod (19) is connected with the casting window cover (20). The third casting window (14) and fourth casting window (43) are equipped with a second cylinder (15) at one side. The piston rod of second cylinder (15) is connected with the second connecting-rod (32). The second connecting-rod (32) is connected with the casting window cover (20). The high pressure casting tank (3) is equipped with the fixed guide (21) and unfixed guide at the bottom, and the unfixed guide is connected with the cylinder. The high pressure casting tank (3) is equipped with a hatch door (27) at one end which is connected with a door connecting-rod (25). The other end of door connecting-rod (25) is connected with the high pressure casting tank (3). The door connecting-rod 25 is an arc curved rod, easy for opening of the hatch door (27) with long lifetime. The hatch door (27) is connected with a third cylinder (26). The high pressure casting tank (3) is equipped with an actuated exhaust ball valve (5) at one side. The high pressure casting tank (3) is equipped with a first guard (30) and a second guard (31) at inner top for opening/closing of the casting port in favor of smooth casting and free of defects. The first guard (30) is connected with the first connecting-rod (19) via couplings, and the second guard (31) is connected with the second connecting-rod (32) via couplings. There are two unfixed guides in this invention. The lower part of first unfixed guide (29) is connected with the first pivot shaft (39), which is connected with the fourth cylinder (24) via a connecting rod. The lower part of second unfixed guide (22) is connected with the second pivot shaft (36), which is connected with the fifth cylinder (38) via a connecting rod. The high pressure casting tank (3) is equipped with a support rod (34) on the inner wall. The high pressure casting tank (3) is equipped with a vacuum pressure gauge (33), manual exhaust pipe (40) and automatic exhaust pipe (23) on the outer wall. In this invention, the sand-box (28) is lifted onto the electric trolley. The unfixed guide in the high pressure casting tank (3) is laid down by the electric system via the cylinder and connecting rod. Then the hatch door (27) is opened via starting the third cylinder 26 driving the door connecting-rod 25. Then the unfixed guide is erected under control of electric signals and via the cylinder driving connecting rod, and is connected with the fixed guide. Press the button on the console, so that the sand-box is delivered to high pressure casting tank (3) steadily by the electric trolley along the guide. Then close the hatch door (27). Now, start the first cylinder (16) and second cylinder (15) to open the casting window via the connecting rod. Put the filler (45) for filling aluminum alloy liquid into the four casting ladles in the high pressure casting tank 3 through the four windows. The casting ladle (44) is above the gate of sand-box. The casting ladle (44) is connected with a swinging cylinder (12) which is for controlling of the inclination of casting ladle (44) for casting. Fill the aluminum alloy liquid into the casting ladles in the high pressure casting tank manually via the filler, and then take out the filler (45). The first cylinder (16) and second cylinder (15) will drive the connecting rod to close the casting window. Now, start the vacuum pump to pumping out the air in the high pressure casting tank (3) quickly to obtain optimum vacuum. Pour the aluminum alloy liquid in the casting ladle (44) slowly into the sand mold cavity. After vacuum casting, the air inlet actuated ball valve 4 is opened, the compressed air in a booster jar (7) is filled into the high pressure casting tank (3) quickly, so that the pressure in the high pressure casting tank (3) reaches 0.6 mpa quickly. Now, aluminum alloy liquid in the casting mold cavity is solidified under pressure via the port and riser.

The castings in this invention is produced in vacuum, so the aluminum parts are compact and free of defects such as pinhole, shrinkage hole, dispersed porosity and secondary slag entrapments etc.

After the casting products are solidified under pressure, open the actuated exhaust ball valve (5) for exhausting. After the pressure inside the high pressure casting tank decreases to zero, erect the unfixed guide, and the sand-box is removed out from the tank body by the electric trolley.

In Figures, the item 6 is the door, item 13 is the vacuum pump, item 35 is the shaft and item 41 the guard.

What is claimed is:

1. An aluminum alloy vacuum casting equipment comprising:

a high pressure casting tank equipped with a guide inside;

the high-pressure casting tank (3) is connected with one end of a compressed air pipe (8), other end of the compressed air pipe (8) is connected with a booster jar (7); the compressed air pipe (8) is equipped with an air inlet actuated ball valve (4);

a first casting window (17) and a second casting window (18) are set at a top of the high-pressure casting tank (3), the first casting window (17) and a second casting window (18) are equipped with a first cylinder (16) at one side;

a piston rod of the first cylinder (16) is connected with a first connecting-rod (19), the first connecting-rod (19) is connected with a casting window cover;

the high pressure casting tank (3) is equipped with a fixed guide (21) and an unfixed guide at a bottom thereof, and the unfixed guide is connected with a cylinder;

the high pressure casting tank (3) is equipped with a hatch door (27) at one end, which is connected with a door connecting-rod (25), the other end of the door connecting-rod (25) is connected with the high pressure casting tank (3);

the hatch door (27) is connected with a third cylinder (26);

the high pressure casting tank (3) is equipped with an actuated exhaust ball valve (5) at one side.

2. The aluminum alloy vacuum casting equipment of claim 1, wherein the high pressure casting tank (3) is equipped with a first guard (30) and a second guard (31) at an inner top, the first guard (30) is connected with the first connecting-rod (19) via couplings, and the second guard (31) is connected with a second connecting-rod (32) via couplings.

3. The aluminum alloy vacuum casting equipment of claim 2, wherein the high pressure casting tank (3) is equipped with a support rod (34) on the inner wall.

4. The aluminum alloy vacuum casting equipment of claim 3, wherein the high pressure casting tank (3) is equipped with a vacuum pressure gauge (33), a manual exhaust pipe (40) and an automatic exhaust pipe (23) on the outer wall.

5. The aluminum alloy vacuum casting equipment of claim 1, wherein there are two unfixed guides, a lower part of the first unfixed guide (29) is connected with a first pivot shaft (39), which is connected with a fourth cylinder (24) via a connecting rod, a lower part of the second unfixed guide (22) is connected with a second pivot shaft (36), which is connected with a fifth cylinder (38) via a connecting rod.

6. The aluminum alloy vacuum casting equipment of claim 5, wherein the high pressure casting tank (3) is equipped with a support rod (34) on the inner wall.

7. The aluminum alloy vacuum casting equipment of claim 6, wherein the high pressure casting tank (3) is equipped with a vacuum pressure gauge (33), a manual exhaust pipe (40) and an automatic exhaust pipe (23) on the outer wall.

8. The aluminum alloy vacuum casting equipment of claim 1, wherein the high pressure casting tank (3) is equipped with a support rod (34) on the inner wall.

9. The aluminum alloy vacuum casting equipment as of claim 8, wherein the high pressure casting tank (3) is equipped with a vacuum pressure gauge (33), a manual exhaust pipe (40) and an automatic exhaust pipe (23) on the outer wall.

* * * * *